US005276984A

United States Patent [19]

Burns

[11] Patent Number: 5,276,984

[45] Date of Patent: Jan. 11, 1994

[54] PICTURE FRAME

[76] Inventor: William Burns, 14 Mill Lane, North Reddish, Stockport, England, SK5 6UU

[21] Appl. No.: 712,431

[22] Filed: Jun. 10, 1991

[51] Int. Cl.[5] ..... G09F 1/12

[52] U.S. Cl. ..... 40/152; 40/152.1; 40/156

[58] Field of Search ..... 40/152, 152.1, 156

[56] References Cited

U.S. PATENT DOCUMENTS

| | | | |
|---|---|---|---|
| 3,060,606 | 10/1962 | Peach | 40/154 |
| 3,142,550 | 7/1964 | Kuehne | 40/154 |
| 4,261,124 | 4/1981 | Carter | 40/156 |
| 4,835,891 | 6/1989 | Joffe | 40/156 |
| 5,042,180 | 8/1991 | Horiuchi | 40/156 |
| 5,058,298 | 10/1991 | Burns | 40/152 X |

*Primary Examiner*—Kenneth J. Dorner
*Assistant Examiner*—C. Hope Davis
*Attorney, Agent, or Firm*—Charles J. Brown

[57] ABSTRACT

A rear loaded picture frame of four integral joined side members having rebates with resilient flaps thereon movable between a first position allowing loading of a picture element and backing board and a second position wherein free edge portions on the flaps are resiliently deformed against the backing board to hold it and the picture elements in position in the rebate.

4 Claims, 2 Drawing Sheets

PICTURE FRAME

This invention concerns a picture frame.

When framing a picture it is first necessary to construct or select a frame of suitable size. A sheet of glass, possibly one or more borders, the picture and a backing sheet or board are then assembled within the rebate of the frame and the backing sheet or board is then secured to the frame to hold the assembly firmly in place.

Various methods for securing the backing are known and include the use of pins or adhesives. Such methods are very time consuming, and, whilst acceptable for a custom-built frame, are generally unsuited to mass production.

It is an object of the present invention to provide a picture frame which overcomes the problems aforesaid.

According to the present invention there is provided a rear loaded rectangular picture frame wherein four side members are joined end-to-end and each side member is formed with a rearwardly facing rebate to receive at least one element to be framed and a backing board, the improvement which comprises (a) the side members being of unitary plastic material and being joined integrally with one another, (b) at least one resilient flap of the same plastic material as the side members extending integrally from and being hingedly connected to the rear of at least an opposite pair of the side members, (c) each of said flaps being movable between a first position in which it lies outside the rebate to allow rear loading of the elements and backing board and a second position within the rebate after loading to hold the elements and backing board in place within the rebate, (d) the flaps having a certain thickness adjacent their hinge connection with the side members and a free edge portion remote from the hinge connection of lesser thickness, (e) the free edge portions being resiliently deformable against the backing board as the flaps are moved into their second position.

The invention will be further apparent from the following description with reference to the figures of the accompanying drawing which show, by way of example only, three forms of picture frame embodying same.

Figure 1:
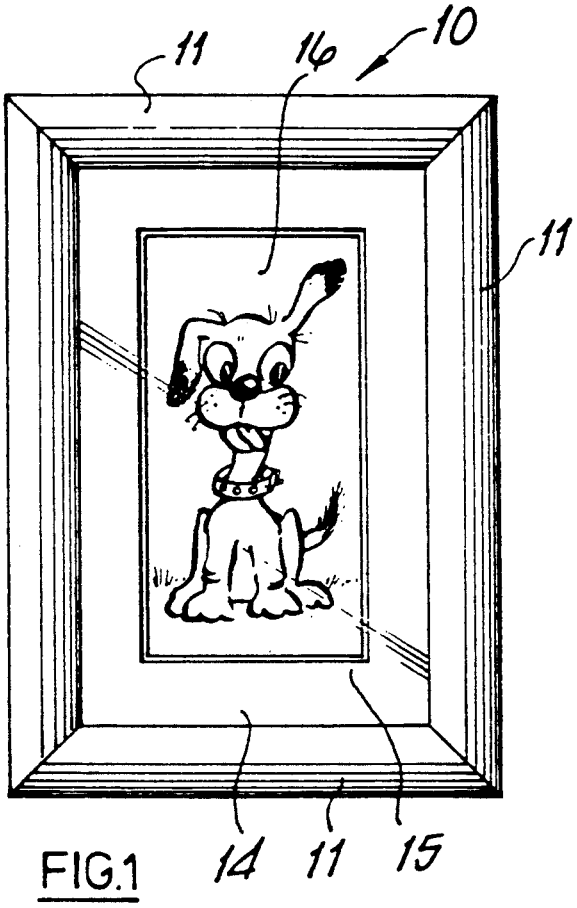
FIG. 1 shows a front elevation of the first form of frame.
Figure 2:
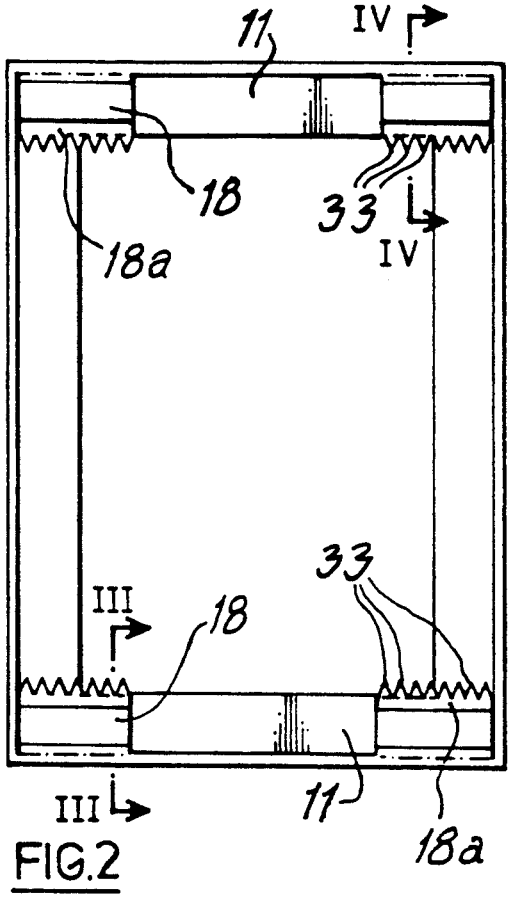
FIG. 2 shows a rear elevation of the frame of FIG. 1.
Figure 4:
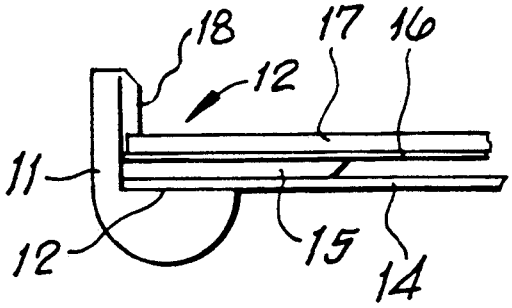
FIG. 4 shows a cross-section through the frame on the line IV—IV of FIG. 2 with the flap in a second position.

Referring now to FIGS. 1–4 of the drawings, it will be seen that the first form of picture frame 10 comprises four side frame members 11 joined at the corners of the frame in known manner. Each of the frame members 11 is rebated at 12 whereby the rear of the frame defines a recess to receive a sheet of glass 14, a border 15, a picture 16 and backing board 17.

An opposite pair of the frame members 11 are each provided with two spaced flaps 18 hingedly connected thereto and integrally formed therewith and movable from first positions (FIG. 3) in which they lie outside the rebate 12 to enable rear loading of the parts 14 to 17 inclusive and second positions (FIG. 4) in which they are folded downwardly into the rebate 12.

Figure 3:
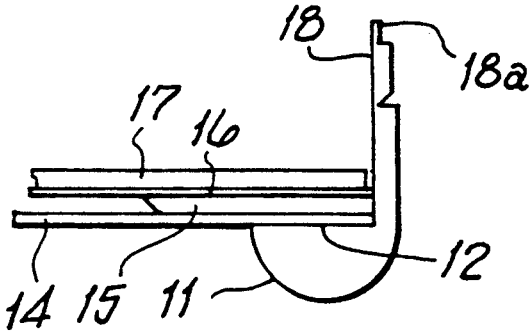
FIG. 3 shows a cross-section through the frame on the line III—III of FIG. 2 with the flap in a first position.

The free edge portions 18*a* of the flaps 18 remote from their hinged connections with the side frame members are of thin section (as best seen in FIG. 3) so as to be resiliently deformable against the board 17 when the flaps are moved into their second positions. The portions 18*a* may be serrated as shown at 33 further to increase their deformability.

In the first form of frame the backing board 17 is a clearance fit within the rebate 12 so that as the flaps 18 are moved fully downwardly into the rebate 12 the edge portions 18*a* fold under the thicker part of the flaps 18 before springing downwardly to locate in the gap between the side frame members and edges of the backing board 17, leaving the thicker parts bearing against the rear face of the backing board to hold it and the underlying elements firmly in position.

The entire frame as described is an integral moulding of a suitable plastics material such as a polypropylene for example, the hinges between the members 11 and flaps 18 being thin bridges connecting the two parts.

The act of framing a picture is simplicity itself, all of the parts being secured simply by folding the four flaps inwardly so that they snap into their second positions.

Figure 5:
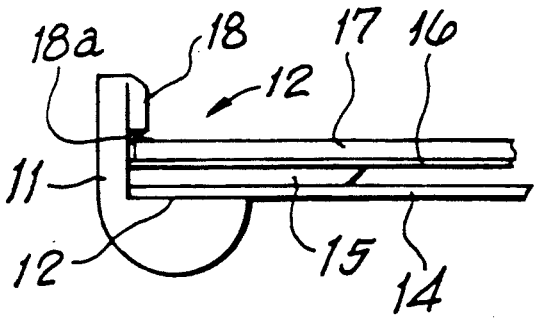
FIG. 5 shows a view similar to FIG. 4 but of modified construction.

In a modified frame shown in FIG. 5, the backing board 17 is an interference fit within the rebate 12. The portions 18*a* remain folded between the thicker parts of the flaps 18 and rear face of the backing board, wedging it into position, when the flaps are in their second position.

Again this frame is formed as an integral plastics moulding.

Figure 6:
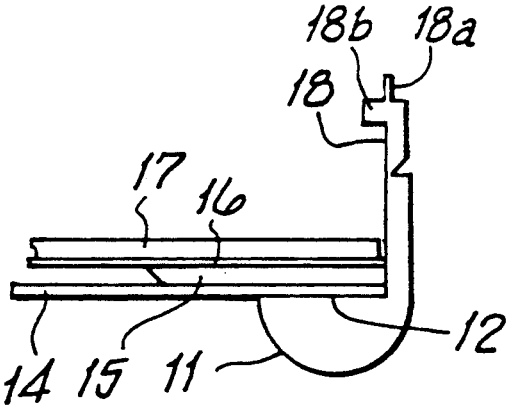
FIG. 6 shows a view similar to that of FIG. 3 but of modified construction.

As shown in FIG. 6 in the third form of frame, each flap 18 is provided with a rib 18*b* to provide increased thickness adjacent the edge portion 18*a*.

It will be appreciated that it is not intended to limit the invention to the above example only, many variations, such as might readily occur to one skilled in the art, being possible, without departing from the scope thereof as defined by the appended claims.

I claim:

1. In a rear loaded rectangular picture frame including four side members joined end-to-end, each side member being formed with a rearwardly facing rebate, and at least one element to be framed and a separate backing board receivable in said rebate, the improvement which comprises (a) the side members being of unitary plastic material and being joined integrally with one another, (b) at least one resilient flap of said plastic material extending rearwardly integrally from and being hingedly connected to at least an opposite pair of the side members, (c) each of said flaps having a first position in which it lies outside the rebate for rear loading of said element and backing board and having a second position within the rebate after loading to hold said element and backing board in place within the rebate, (d) each of the flaps having a portion of a certain thickness adjacent its hinged connection with its side member and a free edge portion remote from the hinged connection of lesser thickness, (e) the free edge portions of the flaps being resiliently deformed against the backing board when the flaps are in their second position, (f) the backing board being of a clearance within the rebate whereby the free edge portions of the flaps extend between the side members and edges of the backing board when the flaps are in their second position and the portions of the flaps of said certain thickness bear against the backing board to hold the backing board in position.

2. A rear loaded picture frame according to claim 1 wherein each flap is provided with a rib to provide increased thickness adjacent said free edge portion.

3. In a rear loaded rectangular picture frame including four side members joined end-to-end and defining a forwardly facing viewing opening, each side member being formed with a rearwardly facing rebate, and at least one element to be framed and a separate backing board adjacent the rearward surface of the element to be frame receivable in said rebate, the improvement which comprises (a) the side members being of unitary plastic material and being joined integrally with one another, (b) at least one resilient flap of said plastic material extending rearwardly integrally from and being hingedly connected to at least an opposite pair of the side members, (c) each of said flaps having a first position in which it lies outside the rebate for rear loading of said element to be framed and said separate backing board and having a second position within the rebate after loading to hold said element and backing board in place within the rebate from the rear such that the element to be framed is secured for viewing through the viewing opening.

(d) each of the flaps having a portion of a certain thickness adjacent its hinged connection with its side member and a serrated free edge portion remote from the hinged connection of lesser thickness, (e) the free edge portions of each flap being resiliently deformed against the backing board when the flap is in its second position.

4. In a rear loaded rectangular picture frame including four side members joined end-to-end and defining forwardly facing viewing opening, each side member being formed with a rearwardly facing rebate, and at least one element to be framed and a separate backing board adjacent the rearward surface of the element to be formed receivable in said rebate, the improvement which comprises (a) the side members being of unitary plastic material and being joined integrally with one another, (b) two resilient flaps of plastic material extending integrally from and being hingedly connected to each of said opposite side members, (c) each of said flaps having a first position in which it lies outside the rebate to for rear loading of said element to be framed and said separate backing board and having a second position within the rebate after loading to hold said element and backing board in place within the rebate such that the element to be framed is secured for viewing through the viewing opening.

(d) each of the flaps having a portion of a certain thickness adjacent its hinged connection with its side member and a free edge portion remote from the hinged connection of lesser thickness, (e) the free edge portions of the flaps being resiliently deformed against the backing board when the flaps are in their second position.

* * * * *